United States Patent [19]

Ahlers

[11] 4,342,344

[45] Aug. 3, 1982

[54] FILLING ELEMENT FOR COUNTERPRESSURE CONTAINER-FILLING MACHINES

[75] Inventor: Egon Ahlers, Neu-Bamberg, Fed. Rep. of Germany

[73] Assignee: Seitz-Werke GmbH, Bad Kreuznach, Fed. Rep. of Germany

[21] Appl. No.: 205,453

[22] Filed: Nov. 10, 1980

[30] Foreign Application Priority Data

Nov. 22, 1979 [DE] Fed. Rep. of Germany ..... 2947035

[51] Int. Cl.[3] ..... B65B 3/26; B65B 31/00

[52] U.S. Cl. ..... 141/39; 141/55; 141/305

[58] Field of Search ..... 137/322; 141/4–6, 141/39, 40, 54–57, 302, 305

[56] References Cited

U.S. PATENT DOCUMENTS 4,206,789 6/1980 Jordan ..... 141/39

*Primary Examiner*—Frederick R. Schmidt

*Attorney, Agent, or Firm*—Becker & Becker, Inc.

[57] ABSTRACT

A filling element for counterpressure container-filling machines. The filling element includes: a filling tube, open at the bottom, for the liquid to be bottled; a liquid valve, arranged ahead of the inlet into the filling tube, which includes an axially displaceable valve body and a filling valve outlet chamber which leads to an inlet in a filling tube; a connecting passage extending from the front surface of the body of the filling element closing the opening of a container pressed on for filling, to the interior of the filling tube, especially the inlet region thereof; and a control valve for opening and closing the connecting passage. The control valve is capable of being actuated in common with the liquid valve in such a manner that, with the liquid valve open, it is closed in the connecting passage, and is open when the liquid valve is closed. The connecting passage, at its end facing the inlet into the filling tube, opens into the filling valve outlet chamber at its peripheral surface by means of a slide-over opening. The connecting passage cooperates with a valve body as a control valve, which is axially slidably guided on the circumferential surface of the filling valve outlet chamber and is secured to the valve body of the liquid valve.

7 Claims, 4 Drawing Figures

FILLING ELEMENT FOR COUNTERPRESSURE CONTAINER-FILLING MACHINES

The present invention relates to a filling element for counterpressure vessel or container filling machines, and includes: a filling tube, open at the bottom, for the liquid to be dispensed or bottled; a liquid valve, arranged ahead of the inlet into the filling tube, which includes an axially displaceable valve body and a filling valve outlet chamber which leads to an inlet in the filling tube; a connecting passage extending from the front surface of the body of the filling element closing the opening of a container placed or pressed on for filling, to the interior of the filling tube, especially the inlet region thereof; and a control valve for opening and closing the connecting passage. The control valve is capable of being actuated in common with the liquid valve in such a manner that, with the liquid valve open, it is closed in the connecting passage, and is open when the liquid valve is closed.

From German Offenlegungsschrift No. 14 32 406, there is known such a filling element in connection with counterpressure filling machines of multichamber construction. However, this known filling element requires a complicated, costly construction of the control valve for opening and closing the connecting passage effective between the interior of the engaged container and the inlet in the filling tube. Such a complex control valve requires more or less precisely working actuating devices and high cost for servicing and cleaning.

From German Pat. No. 11 85 497, there is known a valve-controlled filling element for counterpressure bottle filling machines, with which the control valve is arranged laterally on the filling element body in the connecting passage effective between the interior of the container pressed-on for filling and the inlet region of the filling tube; this control valve is actuated by a control cam of its own. Also this arrangement of the connecting passage and of its control valve is complex and requires high cost for operation, servicing, and cleaning. Furthermore, with this known filling element there is required an additional relief and no-load valve which needs a special switching phase.

Finally, with the commercially available three-chamber filling and closing combinations ROLA-U of the Assignee of the present invention, provision is made to have a bore, for emptying the filling tube, end at the front surface of the filling element body facing the container to be filled; this bore leads at the upper end to the inlet region of the filling tube. With a pressed-on container, the outer opening or mouth of this bore is covered up by a sealing element at the centering tulip or member. This, however, can easily lead to the defect that the outer opening on the bore for emptying the filling tube is only incompletely closed, so that pressure gas losses and accordingly impairing of the filling procedure result. Additionally, with this known device, the emptying of the filling pipe cannot be undertaken with a pressed-on container.

It is therefore an object of the present invention to significantly improve a filling element of the aforementioned type so that with a minimum cost for valve and actuating devices, a safe valve control is obtained at the connecting passage effective between the interior of the container pressed-on for filling and the filling tube inlet, whereby servicing and cleaning of the valve and actuating devices should be free of problems.

This object, and other objects and advantages of the present invention, will appear more clearly from the following specification in connection with the accompanying drawing, in which.

Figures 1, 2, 3, 4:
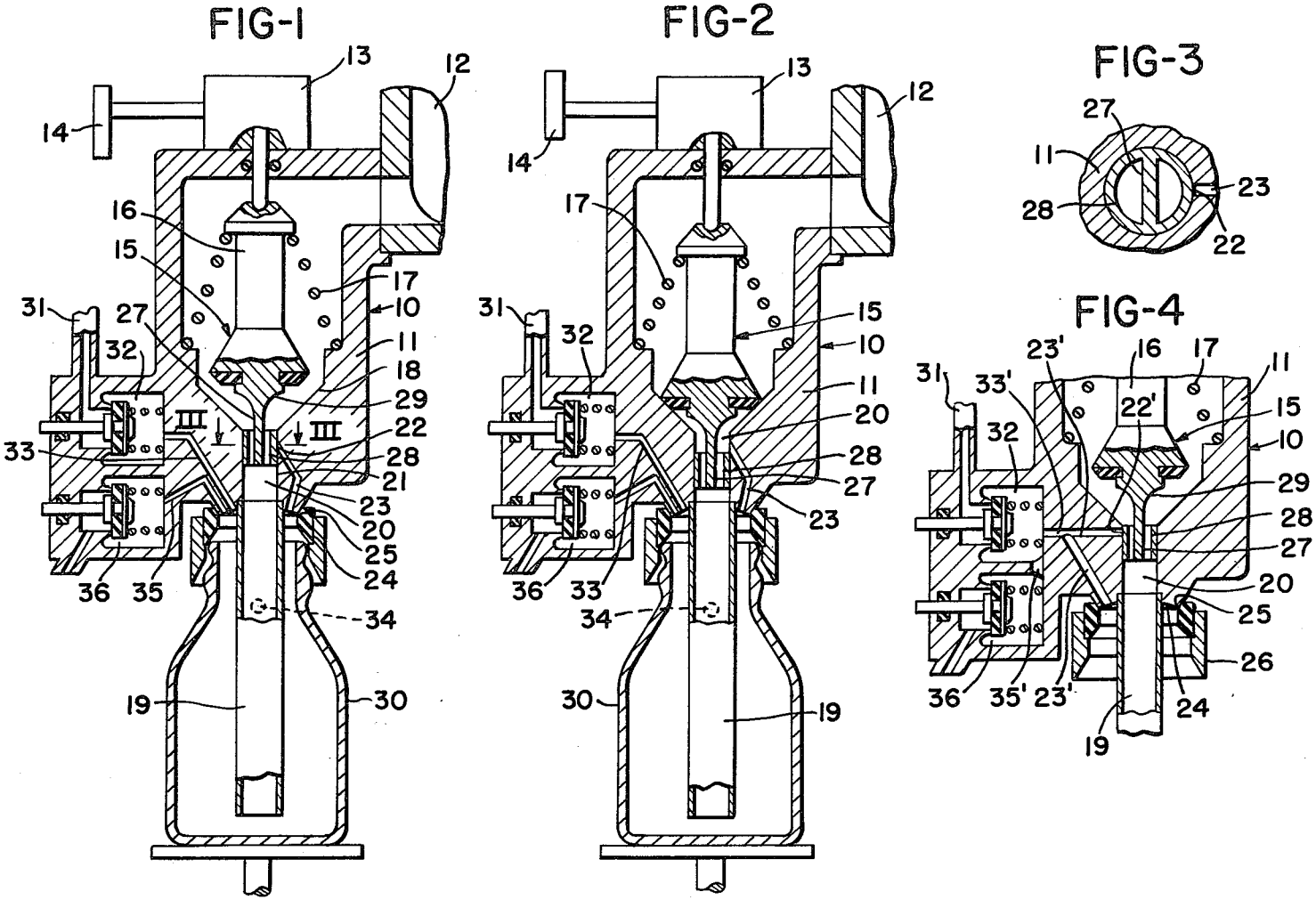
FIG. 1 shows a filling element, with inventive devices, schematically in axial section in the open position of the liquid valve and in the closed position of the control valve.
FIG. 2 shows the filling element of FIG. 1 in the closed position of the liquid valve and in the opened position of the control valve.
FIG. 3 is a partial section taken along line III—III in FIG. 1.
FIG. 4 is a section view of a part of the structure of FIG. 1 though illustrating a modified version of the filling element.

The filling element of the present invention is characterized primarily in that the connecting passage, at its end facing the inlet into the filling tube, opens into the filling valve outlet chamber at its peripheral surface by means of an overlap or slide-over opening. The filling element is further characterized in that the connecting passage cooperates with a valve body as a control valve, which is axially slidably guided on the circumferential surface of the filling valve outlet chamber and is secured to the valve body of the liquid valve. In this manner it is made possible that the control valve for opening and closing the connecting passage requires no actuating device of its own. A fully effective closing of the connecting passage is attained in the closed position of the control valve by the cooperation of the valve body and the overlap or slide-over opening. The valve body of the control valve can have a simple shape and, accordingly, together with the slide-over bore in the circumferential surface of the filling valve outlet chamber, offers the advantage that the control valve and its parts are not liable to become dirty, and that they can be cleaned very easily by a simple rinsing process when preparing the machine for a different filling medium. The manner of operation of the control valve for the connecting passage is particularly simple, safe and certain.

A further essential advantage achieved with the present invention consists in that, simultaneously with the closing of the liquid valve, the connecting passage between the interior of the filled container and the inlet region of the filling tube is immediately reopened, and that thus the liquid level in the container and in the filling tube immediately automatically adapt to each other. Due to this adaptation of the liquid level there is achieved not only an essential acceleration of the entire working procedure, but rather also the relieving step following the actual filling is made considerably easier. The relieving or the reduction of the gas overpressure in the filled container becomes likewise simultaneously effective in the upper part of the container and in the interior of the filling tube by the immediate opening of the connecting passage.

In a preferred embodiment of the present invention, the filling valve outlet chamber is embodied with a cylindrical circumferential surface, while the valve body of the control valve is a cylindrical ring axially slidably guided inside this circumferential surface; this ring is connected with the valve body of the liquid valve by a valve body carrier which essentially leaves free the axial passage through this cylindrical or annular valve body of the control valve. In this manner, with the liquid valve opened, the valve body of the control valve offers no noteworthy flow resistance to the liquid flowing through, so that no impairing of the actual filling procedure occurs.

With this embodiment of the present invention, the valve body carrier in essence can have the form of an axially extending plate. In this way, the valve body of the control valve and the valve body carrier form a guiding and calming-down body for the fluid flow, this body being arranged in the filling valve outlet chamber. Such a body has been provided with the known filling elements having a filling tube already additionally in the manner of a slotted throttle pin (compare German Auslegeschrift No. 11 80 642). Accordingly, with this embodiment of the present invention, there can additionally be attained the advantageous effect of a flow guiding means in the filling valve outlet chamber.

With filling elements for counterpressure container filling machines, a path or passage for the pressurizing gas is to be provided in the filling element body, mostly in the form of one or more passages. In accordance with the teaching of the present invention, the connecting passage can be arranged separately from this passage for the pressurizing gas. However, it is also possible to combine, with the connecting passage a, passage for the pressurizing or relief gas provided in the filling element body after or behind the pressurizing valve associated therewith. A connecting passage to the relief valve may also be provided.

For always assuring a definite access to the connecting passage at the end surface of the filling element body covering the container pressed-on for filling, it is recommended to have the connecting passage, at the end surface of the filling element body covering the opening of a container pressed-on for filling, terminate in an annular groove which surrounds the filling tube; this annular groove itself is surrounded by an annular sealing seat for a connecting and sealing element for the container. This connecting and sealing element generally is a centering tulip or member.

Referring now to the drawings in detail, a filling element 10 is shown having a filling element body 11, which is arranged laterally on a filling-medium chamber 12, for example a filling medium annular chamber, and is provided on its top side with an actuating device 13 with a control lever 14 for the liquid valve 15. The liquid valve 15 comprises an axially shiftable valve body 16 which is lifted from its valve seat 18 by a spring 17. Below the valve seat 18, a filling valve outlet chamber 20 with a cylindrical circumferential surface 21 is formed and serves as transition to or introduction into the filling tube 19. A slide-over opening 22 is provided in the upper part of this cylindrical surface 21 from which a connecting passage 23 leads to the end surface of the filling element body 11 which covers the opening of a container 30 pressed-on for filling; more particularly, the passage 23 leads into an annular groove 24 surrounding the filling tube 19 and provided at this location. The annular groove 24 in turn is surrounded by a sealing seat 25 for a connecting and sealing element, for example a centering bell or member 26 (FIG. 4), for the container 30. A valve body 28 of the control valve for opening and closing the connecting passage 23 is connected to the outlet end of the valve body 16 of the liquid valve 15 by means of a plate-shaped valve body carrier 27. This annular valve body 28 has its outer circumferential surface so adapted to the cylindrical circumferential surface 21 of the filling valve outlet chamber 20 that it is axially slidably and sealingly guided in the filling valve outlet chamber 20. As shown at 29, the plate-shaped valve body carrier 27 can be joined to the underside of the valve body 16 by a curved or arched transition to avoid turbulence in the flow of the liquid passing through the liquid valve 15 and the valve body 28.

In the example of FIGS. 1 and 2, the gas supply necessary for the pressurizing is effected from a gas supply line 31 by way of the pressurizing valve 32 with a channel-like path 33 through the filling element body 11 as far as to the annular groove 24, but otherwise is separate from the connecting passage 23. The connecting passage 35 of the relief valve 36 is also separate therefrom. The return gas conduit, not illustrated in greater detail, which is necessary for the return gas discharge, leads either directly into the atmosphere by way of a nozzle, or into a separate return gas chamber by way of a nozzle, or into a gas space maintained above the level of the filling medium of the filling medium chamber 12. The ingate of this return gas conduit which determines the filling level is designated with the reference numeral 34.

The embodiment according to FIG. 4 differs from that of FIGS. 1, 2 and 3 only therein that the channel-like path 33' for the pressurizing gas is united with the connecting passage 23' after the pressurizing valve 32, and that the relief valve 36 is connected by way of the connecting passage 35' with the channel-like path 33' after the pressurizing valve 32.

The manner of operation of the filling element of both embodiments is as follows:

The pressurizing occurs with a closed liquid valve 15 and opened control valve 22, 28 of the connecting passage 23 or 23' by way of the gas conduit 31, which with multichamber counterpressure container-filling machines is connected to a separate gas chamber, and with single-chamber counterpressure container-filling machines is connected to the gas space above the level of the filling medium of the filling medium chamber 12, and also by way of the pressurizing valve 32 and the pressurizing path 33 or 33', 23'. Consequently, the pressurizing gas goes directly into the pressed-on container 30 by way of the container opening or by way of the container opening and the filling pipe 19. After pressure equalization is effected, whereby the spring 17 lifts the valve body 16 from its seat 18, the valve body 16 takes the annular valve body 28 along in an upward direction. The valve body 28 consequently closes the slide-over opening 22 or 22', including the connecting passage 23 or 23'. The now starting filling medium inflow by way of the control valve 28 and the filling tube 19 into the pressed-on container 30 effects the return gas discharge by way of the ingate 34 into the gas space of the liquid container 12, or by way of a nozzle into a separate return gas chamber, or by way of the nozzle directly into the atmosphere.

At the earliest upon entry of the filling medium rising in the container 30 into the ingate 34, the liquid valve 15 is positively closed by means of the actuating device 13. At the same time, the valve body 16 of the liquid valve 15 moves the valve body 28 of the control valve in the filling valve outlet chamber 20 into the position illustrated in FIG. 2, in which the connecting passage 23 or 23' is again opened. Consequently, pressure equalization occurs between the interior of the filled container 30 and the filling valve outlet chamber 20, with the result that the same liquid level adjusts itself in the container 30 and in the interior of the filling tube 19.

The pressure relief above the liquid level of the container 30, which pressure relief terminates the filling procedure, can then occur either by way of the passage 35 and the relief valve 36, or the connecting passage 23', pressurizing path 33', bore 35', and relief valve 36. With a relatively still filling medium, the filled container 30 may simply be lowered so that the pressure relief takes place through the air gap appearing at the pressing-on and sealing device 26. The complete emptying of the filling tube 19 occurs automatically with the lowering of the filled container 30, since air can flow into the filling valve outlet chamber 20 and the filling pipe or tube 19 by way of the connecting passage 23 or 23'. Since the connecting passage 23 or 23', especially its slide-over opening 22, the valve body 28, and the valve body carrier 27 are arranged closely adjacent to or in the filling valve outlet chamber 20, they can be cleaned by simply rinsing them by means of the liquid path.

It is to be understood that the foregoing valve actuations for the pressurizing gas, the filling medium, and the pressure relief for the described filling elements can be effected respectively during one cycle of the filling machine in the mentioned sequence of pressurizing, filling, and pressure relieving, and that this can be carried out by switching elements. Such switching elements are usually embodied in the form of cams, curves, and the like arranged on the machine frame in the running or circular path of the valves, or they are associated with the valves themselves and are electrically or pneumatically actuatable.

The present invention is, of course, in no way restricted to the specific disclosure of the specification and drawing, but also encompasses any modifications within the scope of the appended claims.

What I claim is:

1. A filling element for counterpressure container-filling machines, said filling element comprising:

a filling element body which is in communication with a liquid filling-medium chamber;

a filling tube connected to said filling element body and open at both ends, with a first open end communicable with said filling-medium chamber for receiving said liquid, and a second open end communicating with a container which is placed thereover for receiving said liquid therefrom;

a liquid valve, which includes an axially displaceable valve body, for selectively completing and interrupting communication of said filling-medium chamber with said filling tube, said filling element body including a filling valve outlet chamber which is interposed between said valve body and said first open end of said filling tube, and has an inner peripheral surface, said filling element body also including a connecting passage, one end of which is communicable with a container placed over said second open end of said filling tube, the other end of which has a slide-over opening into said peripheral surface of said outlet chamber; and a control valve, in the form of a valve body, for selectively opening and curving said slide-over opening of said connecting passage, said control valve body being connected to said valve body of said liquid valve, and being axially slidably guided on said peripheral surface of said outlet chamber, said control valve being actuatable in common with said liquid valve in such a manner that when said liquid valve is open, said control valve is closed, and when said liquid valve is closed, said control valve is open.

2. A filling element according to claim 1, in which said peripheral surface of said outlet chamber is cylindrical, said valve body of said control valve is a cylindrical ring which is axially slidably guided inside said cylindrical peripheral surface, and said valve body of said liquid valve includes a valve body carrier to which said cylindrical ring is connected and which essentially leaves free the axial passage through said cylindrical ring.

3. A filling element according to claim 2, in which said valve body carrier essentially has the shape of an axially extending plate.

4. A filling element according to claim 1, in which said filling element body includes a channel communicable with a source of pressurized gas and with a container placed over said second open end of said filling tube, said channel and said connecting passage not being connected to one another.

5. A filling element according to claim 1, in which said filling element body includes a channel communicable with a source of pressurized gas and with said connecting passage, a pressurizing valve interposed between said source of pressurized gas and said channel, a relief valve, and a connecting passage connecting said channel with said relief valve.

6. A filling element according to claim 1, in which that end of said filling element body which faces a container placed over said second open end of said filling tube is provided with an annular groove which surrounds said filling tube, said one end of said connecting passage opening into said annular groove, and which includes an annular sealing seat connected to said filling element body and surrounding said annular groove, and a connecting and sealing element for a container placed over said second open end of said filling tube, said connecting and sealing element being connected to said sealing seat.

7. A filling element according to claim 6, in which said connecting and sealing element is a centering member.

* * * * *